US007450888B2

(12) United States Patent
Jeon et al.

(10) Patent No.: US 7,450,888 B2
(45) Date of Patent: Nov. 11, 2008

(54) IMAGE FORMING APPARATUS AND METHOD OF DETECTING HOME POSITION ERROR BY SENSING AN INDICATING UNIT

(75) Inventors: Jun-bae Jeon, Yongin-si (KR); Cheol-ju Yang, Suwon-si (KR); Su-kyoung Chae, Seoul (KR); Young-joon Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/490,038

(22) Filed: Jul. 21, 2006

(65) Prior Publication Data

US 2007/0019993 A1 Jan. 25, 2007

(30) Foreign Application Priority Data

Jul. 21, 2005 (KR) ..... 10-2005-0066367

(51) Int. Cl.
*G03G 15/01* (2006.01)

(52) U.S. Cl. ..... 399/223; 399/228; 399/231; 399/234

(58) Field of Classification Search ..... 399/223, 399/36, 228, 231, 234, 31, 53, 54, 126, 265, 399/279; 74/333, 335, 640
See application file for complete search history.

(56) References Cited

U.S. PATENT DOCUMENTS 5,579,092 A 11/1996 Isobe
6,763,202 B2 * 7/2004 Maeda ..... 399/53

FOREIGN PATENT DOCUMENTS

| | | |
|---|---|---|
| JP | 58-092586 | 6/1983 |
| JP | 05-238071 | 9/1993 |
| JP | 06-015940 | 1/1994 |

OTHER PUBLICATIONS

English translation of JP 06-015940.*

* cited by examiner

*Primary Examiner*—David M. Gray
*Assistant Examiner*—Geoffrey T Evans
(74) *Attorney, Agent, or Firm*—Roylance, Abrams, Berdo & Goodman, L.L.P.

(57) ABSTRACT

An image forming apparatus and a method of detecting a home position error are provided. The image forming apparatus includes a plurality of developing units, a cam shaft, and a plurality of cams that are formed on the cam shaft to correspond to the respective developing units. A power transmitting element is installed between the plurality of developing units and the plurality of cams and selectively transmits a rotational force of a driving source to the plurality of developing units according to a rotational phase of the cam shaft. An indicating element is installed on the cam shaft and includes a plurality of indicating units. A sensor senses the plurality of indicating units. A home position error is detected each time when the indicating units pass through the sensor.

5 Claims, 9 Drawing Sheets

IMAGE FORMING APPARATUS AND METHOD OF DETECTING HOME POSITION ERROR BY SENSING AN INDICATING UNIT

CROSS-REFERENCE TO RELATED PATENT APPLICATIONS

This application claims the benefit under 35 U.S.C. § 119 (a) of Korean Patent Application No. 10-2005-0066367, filed on Jul. 21, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that controls a home position and a plurality of color developing positions using a plurality of indication marks, and a method of detecting a home position error using the same.

2. Description of the Related Art

Generally, an electrophotographic color image forming apparatus produces a color image by forming an electrostatic latent image on a photosensitive medium charged with a uniform electrostatic potential by scanning light onto the photosensitive medium. The electrostatic latent image is developed by providing toner of a predetermined color thereto. The image developed on the photosensitive medium is transferred and fused to a printing medium. Such a color image forming apparatus typically uses four color toners, which are yellow (Y), magenta (M), cyan (C), and black (K) color toners. Therefore, four developers are needed, each of which attaches a color toner onto an electrostatic latent image.

There are two types of color image forming apparatuses. One is a single-pass type color image forming apparatus that includes four exposure units and four photosensitive media. The other type is a multi-pass type color image forming apparatus that includes a single exposure unit and a single photosensitive medium.

When a single pass type color image forming apparatus is used, it takes the same amount of time to perform color printing as does monochrome printing. Thus, the single pass color image forming apparatus performs high-speed printing. However, this type of color image forming apparatus is costly because four exposure units and four photosensitive drums are required. A multi-pass type color image forming apparatus includes a single photosensitive drum and a single exposure unit. A color toner image is formed on an intermediate transfer medium by repeating a light exposing operation, a developing operation and a transferring operation of each color. The toner color image is transferred and fused onto a printing medium. Thus, the multi-pass color image forming apparatus performs low-speed printing.

In the multi-pass type image forming apparatus, because four developers are sequentially operated, a device for consecutively transmitting a rotational force of a driving motor to the four developers is required. To do this, the conventional image forming apparatus uses four electronic clutches, and thus the image forming apparatus is expensive and bulky. Furthermore, when the clutches slip, a driving force of the driving motor cannot be timely controlled.

Accordingly, a need exists for an image forming apparatus having an indicating element with indicating units of different sizes and that detects occurrence of a home position error, thereby improving image quality.

SUMMARY OF THE INVENTION

The present invention provides an image forming apparatus that reliably controls a driving force applied to a developer and detects a home position error at every developing step, and a method of detecting the home position error.

According to an aspect of the present invention, an image forming apparatus includes a plurality of developing units, a cam shaft, and a plurality of cams that are formed on the cam shaft to correspond to the respective developing units. A power transmitting element is installed between the plurality of developing units and the plurality of cams and selectively transmits a rotational force of a driving source to the plurality of developing units according to a rotational phase of the cam shaft. An indicating element that is installed on the cam shaft and includes a plurality of indicating units. A sensor senses the plurality of indicating units. A home position error is detected each time when the indicating units pass through the sensor.

Other objects, advantages, and salient features of the invention will become apparent from the detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
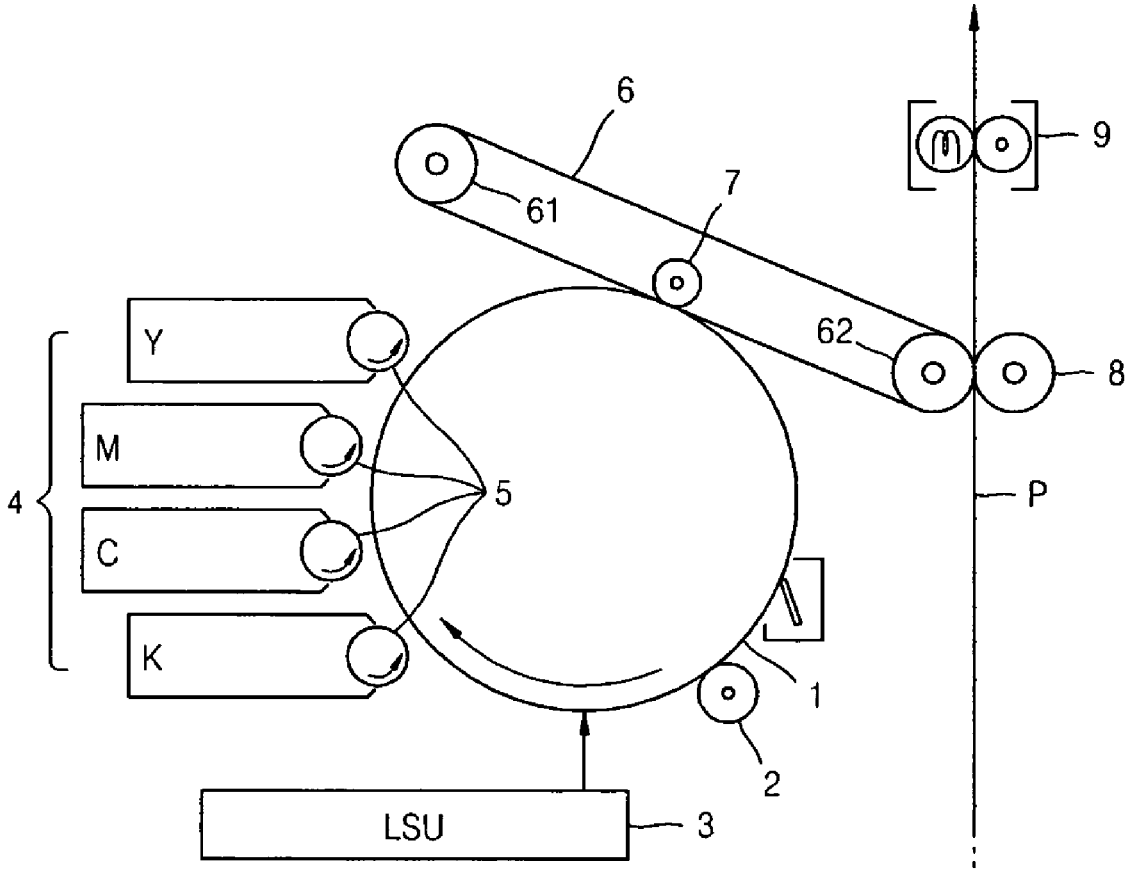
FIG. 1 is a schematic view of a multi-pass type image forming apparatus according to an exemplary embodiment of the present invention.

FIG. 1 is a schematic view of a multi-pass type image forming apparatus according to an exemplary embodiment of the present invention.

Referring to FIG. 1, the image forming apparatus includes a photosensitive drum 1, a charging roller 2, an exposure unit 3, developing units 4, an intermediate transfer belt 6, a first transfer roller 7, a second transfer roller 8, and a fuser 9.

The photosensitive drum 1 is formed by coating an outer circumference of a cylindrical metal drum with a photoconductive layer.

The charging roller 2 charges the photosensitive drum 1 to a uniform electrostatic potential. The charging roller 2 charges the outer circumference of the photosensitive drum 1 to a uniform potential while rotating in contact or non-contact with the outer circumference of the photosensitive drum 2. A corona charger (not shown) may be used instead of the charging roller 2.

The exposure unit 3 forms an electrostatic latent image by scanning light corresponding to image data onto the photosensitive drum 1 charged with a uniform electrostatic potential. A laser scanning unit (LSU) that uses a laser diode as a light source is generally used as the exposure unit 3.

The image forming apparatus uses toner of cyan (C), magenta (M), yellow (Y), and black (K) colors to print a color image.

The image forming apparatus includes four developing units 4, each containing one of cyan (C) toner, magenta (M) toner, yellow (Y) toner, and black (K) toner. Each of the developing units 4 includes a developing roller 5. The developing units 4 are placed such that the developing rollers 5 are spaced from the photosensitive drum 1 by a developing gap, and perform a non-contact developing operation. The developing gap may be between several tens and several hundreds of microns. Each of the developing units 4 may further include a supplying roller (not shown) that provides toner to the developing roller 5, and an agitator (not shown).

The intermediate transfer belt 6 is supported by supporting rollers 61 and 62 and travels at substantially the same velocity as the photosensitive drum 1. The length of the intermediate transfer belt 6 is at least equal to or longer than the length of the maximum sized printing medium P used for the image forming apparatus.

The first transfer roller 7 is placed opposite to the photosensitive drum 1, and a first transfer bias voltage is supplied to the first transfer roller 7 to transfer a toner image developed on the photosensitive drum 1 to the intermediate transfer belt 6.

The second transfer roller 8 is disposed opposite to the intermediate transfer belt 6. The second transfer roller 8 is spaced from the intermediate transfer belt 6 while the toner image is transferred from the photosensitive drum 1 to the intermediate transfer belt 6, and contacts the intermediate transfer belt 6 with a predetermined pressure when the toner image is completely transferred to the intermediate transfer belt 6. A second transfer bias voltage is supplied to the second transfer roller 8 to completely transfer the toner image to a printing medium P.

Procedures for forming an image by the above structure are briefly described below. Light corresponding to, for example, yellow (Y) color image data is scanned from the exposure unit 3 onto the photosensitive drum 1 that has been charged with a uniform electrostatic potential by the charging roller 2. An electrostatic latent image corresponding to the yellow (Y) color image is formed on the photosensitive drum 1. A developing bias voltage is supplied to the developing roller 5 of a yellow developing unit 4Y. Then, yellow (Y) toner is attached to the latent image and a yellow (Y) color toner image is developed on the photosensitive drum 1. The yellow (Y) toner image is transferred to the intermediate transfer belt 6 by the first transfer bias voltage supplied to the first transfer roller 7. When the transferring of a yellow (Y) toner image onto a page of printing medium is completed, the exposure unit 2 forms an electrostatic latent image corresponding to, for example, a magenta (M) color image by scanning light corresponding to a magenta (M) toner image onto the photosensitive drum 1 charged with a uniform electrostatic potential by the charging roller 2. A magenta developing unit 4M develops the electrostatic latent image by supplying magenta (M) toner thereto. A magenta (M) toner image formed on the photosensitive drum 1 is transferred to overlap the yellow (Y) toner image that has already been transferred to the intermediate transfer belt 6. The same process for a cyan toner image and a black toner image are performed, and a color toner image is formed on the intermediate transfer belt 6 by overlapping the yellow (Y), magenta (M), cyan (C), and black (K) toner images. The color toner image is transferred to the printing medium P passing between the intermediate transfer belt 6 and the second transfer roller 8 by the second transfer bias voltage. The fuser 9 fuses the color toner image onto the printing medium P by applying heat and pressure to the color toner image.

As described above, in the multi-pass type image forming apparatus, a plurality of developing units 4 operate sequentially. A developing bias voltage may be supplied to a selected developing unit (for example, 4Y); and to the rest of the developing units (for example, 4M, 4C, and 4K), developing bias voltage may not be supplied or a developing prevention bias voltage may be supplied. The developing roller 5 of only the selected developing unit (for example, 4Y) may rotate, and the developing rollers 5 of the rest of the developing units (for example, 4M, 4C, and 4K) may not rotate. The image forming apparatus includes a power transmitting unit that selectively transmits a driving force to the plurality of developing units 4 and a cam device that operates the power transmitting unit.

Figure 2:
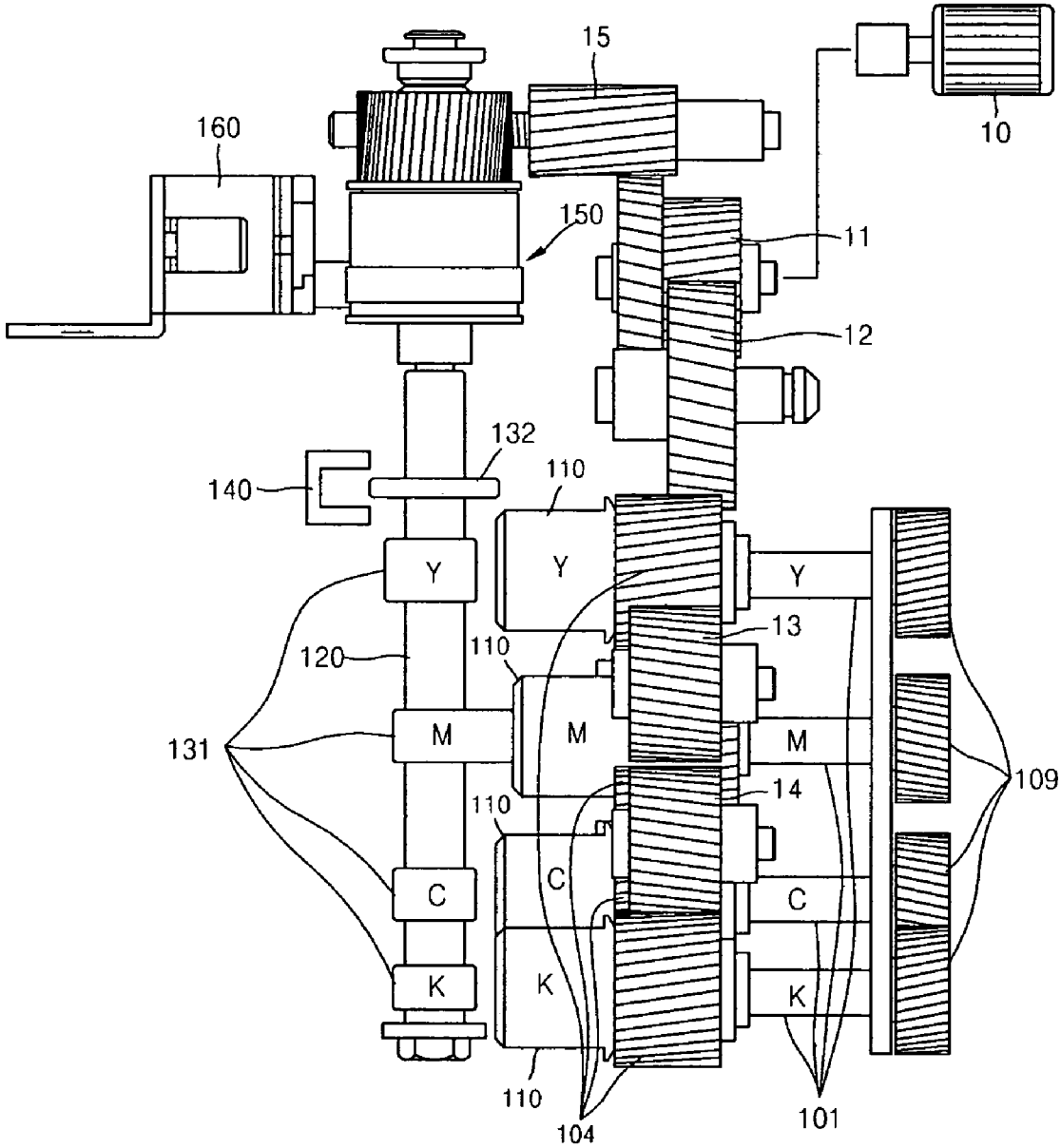
FIG. 2 is a plan view of a device for selectively driving a plurality of developing units according to an exemplary embodiment of the present invention.
Figure 3:
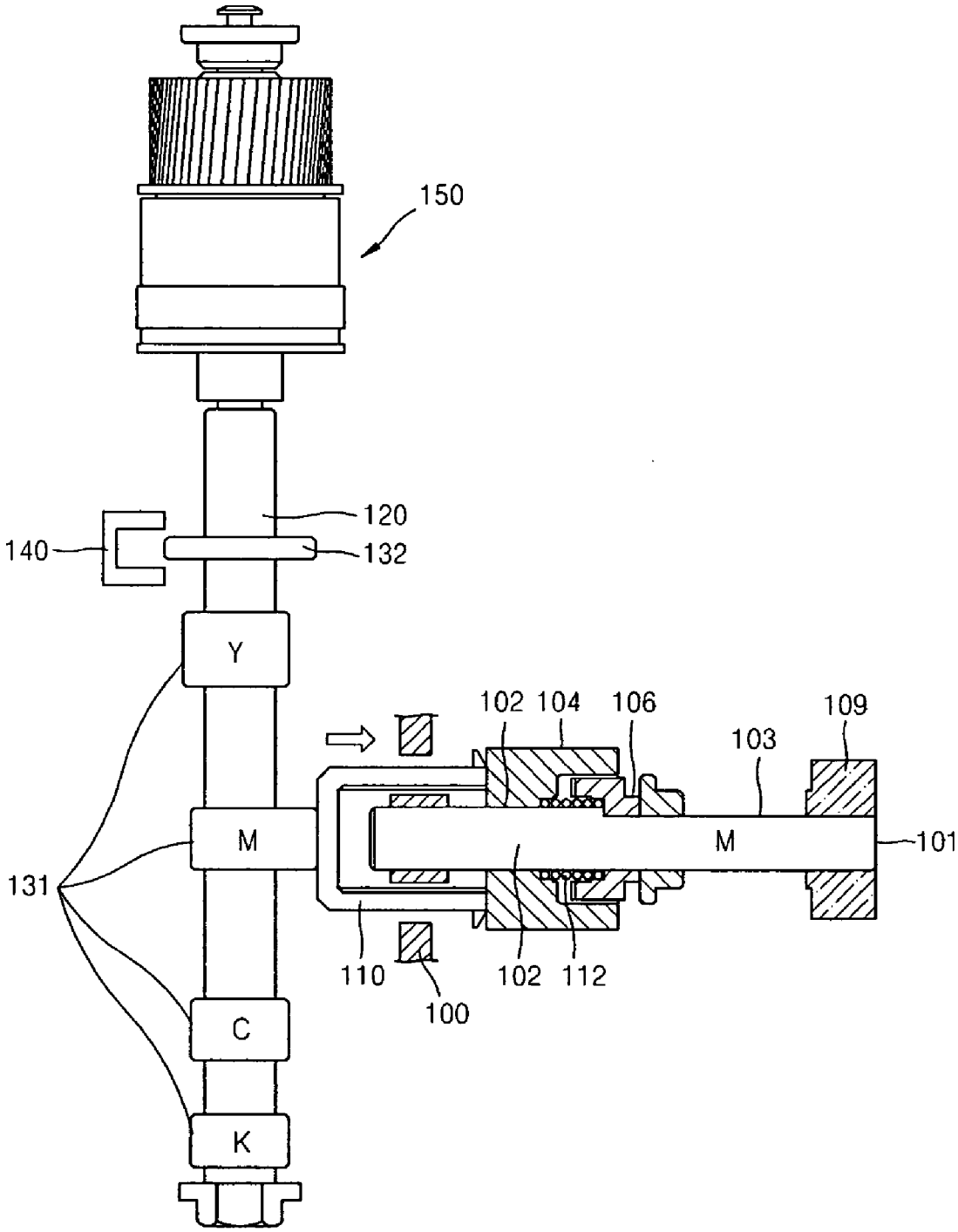
FIG. 3 is a top plan view of FIG. 2 in partial cross section.
Figure 4:
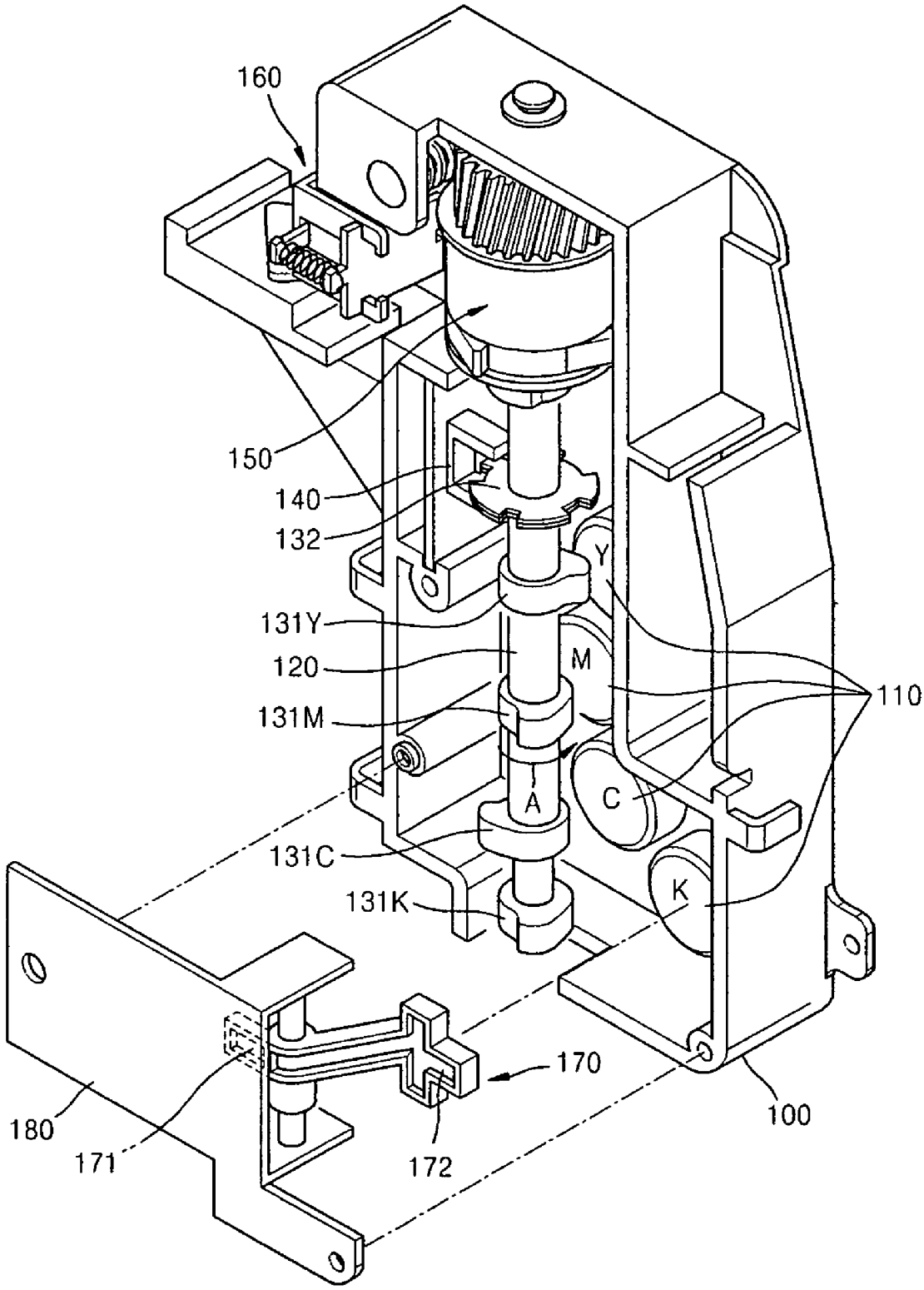
FIG. 4 is a perspective view of FIG. 2.
Figure 5:
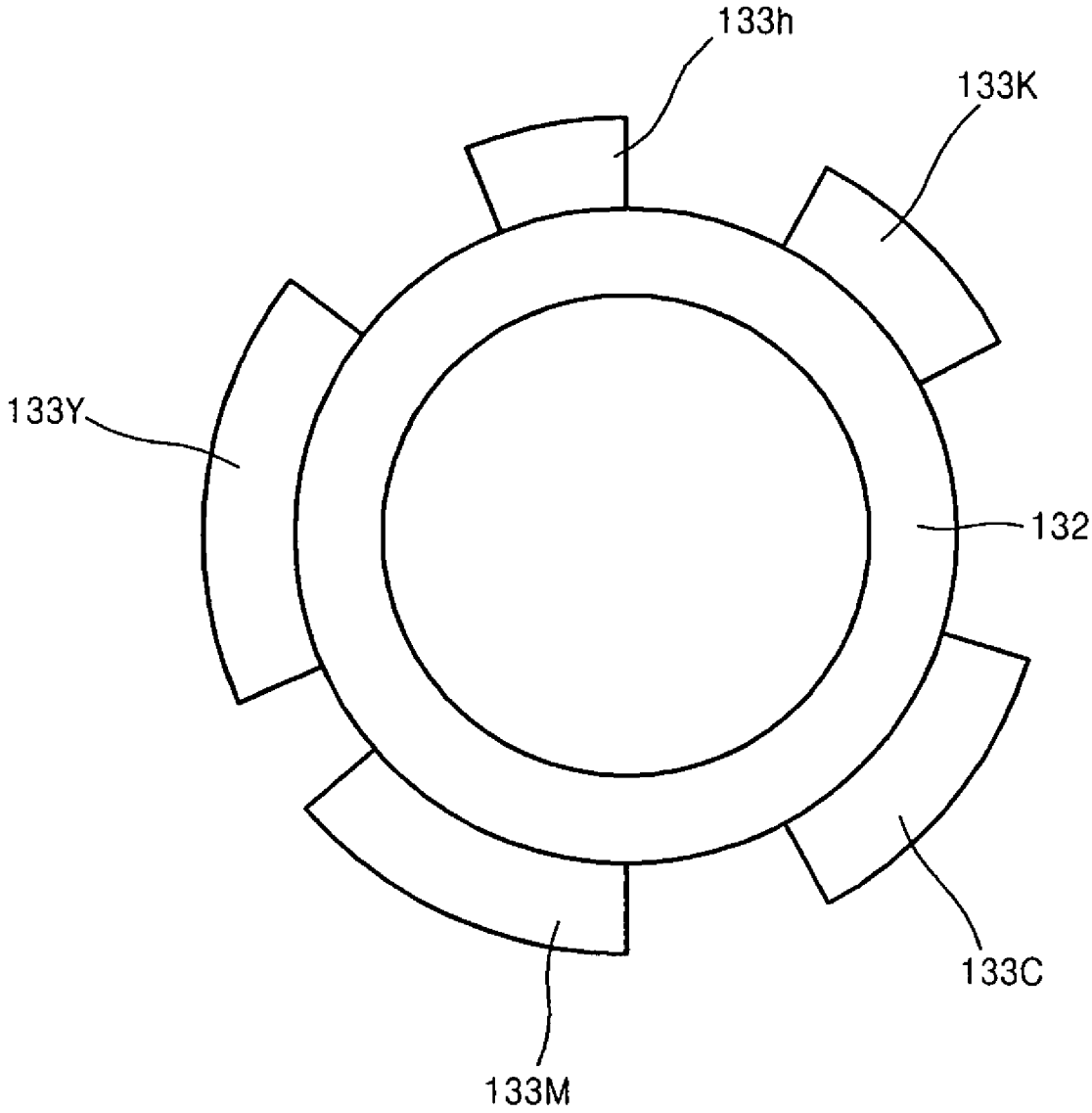
FIG. 5 is a plan view of an indicating element according to an exemplary embodiment of the present invention.
Figure 6:
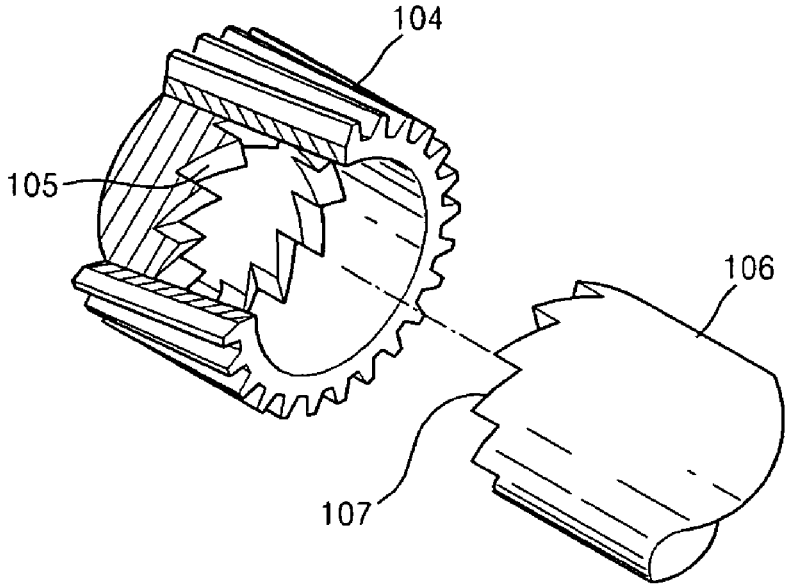
FIG. 6 is a perspective view in partial cross section of a sliding hub and a fixed hub of FIG. 2.
Figure 7:
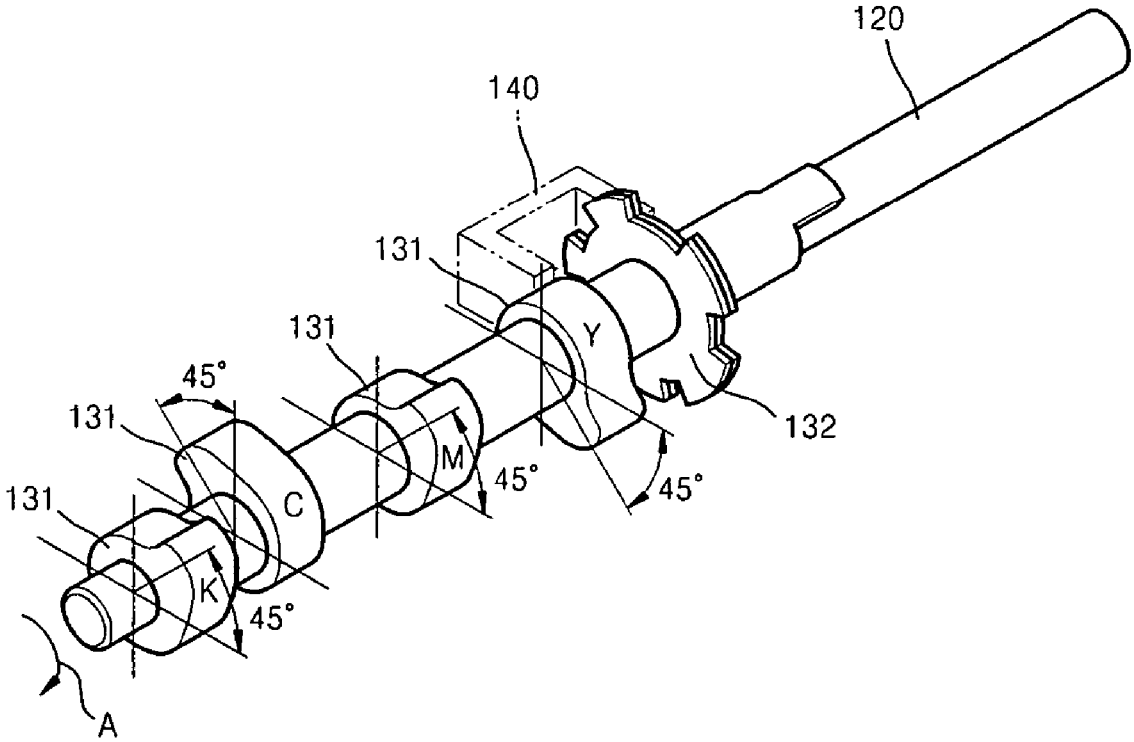
FIG. 7 is a perspective view of a cam shaft and cams of FIG. 2.

FIG. 2 is a plan view of a device for selectively driving a plurality of developing units according to an exemplary embodiment of the present invention. FIG. 3 is a plan view in partial cross section of FIG. 2. FIG. 4 is a perspective view of FIG. 2. FIG. 5 is a plan view of an indicating element according to an exemplary embodiment of the present invention. FIG. 6 is a perspective view in partial cross-section of a sliding hub 104 and a fixed hub 106. FIG. 7 is a perspective view of a cam shaft 120 and cams 131.

Referring to FIGS. 2 through 7, four shafts 101 are rotatably supported by a bracket 100. Each of the shafts 101 includes a cylindrical portion 102 and a substantially D-shaped portion 103. A sliding hub 104 is installed on the cylindrical portion 102. A fixed hub 106 is fitted to an end of the substantially D-shaped portion 103 and a driving gear 109 is installed on the other end of the substantially D-shaped portion 103. An elastic member 112 elastically biases the sliding hub 104 away from the fixed hub 106. A sliding hub 104Y is connected to a driving motor (driving source) 10 by gears 11 and 12. The sliding hub 104Y and a sliding hub 104M are connected to each other by a gear 13. The sliding hub 104C is connected to the driving motor 10 by a plurality of gears, which are not illustrated. Referring to FIG. 6, the sliding hub 104 and the fixed hub 106 include meshing portions 105 and 107 having intercomplementary shapes. Therefore, when the sliding hub 104 and the fixed hub 106 are engaged with each other, the driving force of the driving motor 10 is transmitted to the fixed hub 106, and the shaft 101 and the driving gear 109 rotate. The driving gear 109 is connected to an idle gear (not shown) included in each of the developing units 4. The idle gear is connected to the developing roller 5 as well as to other driving elements included in each of the developing units 4.

According to the above-described structure, the four developing units 4 may be selectively driven by selectively sliding the four sliding hubs 104 to mesh with the four fixed hubs 106.

Referring to FIG. 7, the image forming apparatus further includes the cam shaft 120 and the four cams 131 to selectively slide the four sliding hubs 104.

The four cams 131 are formed on the cam shaft 120 to correspond to the four sliding hubs 104. The four cams 131 and the cam shaft 120 may be formed of injection molded plastic in a single body. The phases of the four cams 131 are different. When the cam shaft 120 rotates, the four cams 131 sequentially push the four sliding hubs 104, thereby coupling the sliding hubs 104 to the respective fixed hubs 106.

The image forming apparatus of an exemplary embodiment includes four push caps 110. The cams 131 push the push caps 110, thereby sliding the sliding hubs 104.

The cam 131 smoothly couples the sliding hub 104 to the fixed hub 106 and may have a trajectory that allows the sliding hub 104 to quickly separate from the fixed hub 106.

Referring to FIG. 4, the cams 131Y, 131M, and 131C may respectively push the corresponding push caps 110Y, 110M, and 110C. However, the cam 131K cannot push the corresponding push cap 110K because the cam 131K is spaced too far away from the push cam 110K. Therefore, a connection element 170 is provided to connect the cam 131K and the push cap 110K. The connection element 170 is pivotably coupled to a cover 180. The cover 180 is coupled to the bracket 100. When the cam 131K pushes an end 171 of the connection element 170, the connection element 170 pivots and the other end 172 of the connection element 170 pushes the push cap 110K.

The cams 131Y, 131M, 131C, and 131K are disposed as illustrated in FIG. 7. The cams 131M and 131C are respectively disposed at 90 and 180 degrees opposite to the rotation direction A of the cam 131Y and the cam shaft 120. The cam 131K pushes the corresponding push cap 110K by operating the connection element 170. The end 171 of the connection element 170 is disposed opposite to the push cap 110K. Therefore, the cam 131K is disposed at 270 degrees opposite to the rotation direction A of the cam 131C and the cam shaft 120.

The cam shaft 120 is rotated by the driving motor as shown in FIGS. 2 and 3. The cam shaft 120 rotates only when the rotational force of the driving motor 10 transmitted to the developing units 4 is cut off. The electrophotographic image forming apparatus includes a regulating element that regulates the rotational force of the driving motor 10 transmitted to the cam shaft 120. For example, the regulating element includes a spring clutch 150 and an actuator 160 that selectively operates the spring clutch 150.

Figure 8:
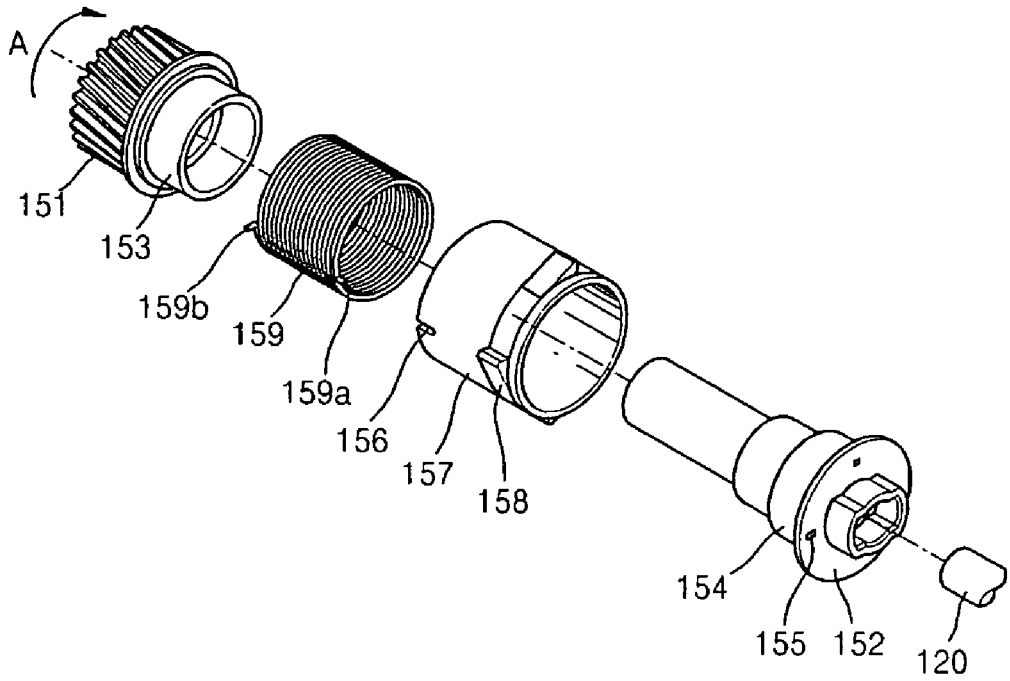
FIG. 8 is an exploded perspective view of the spring clutch of FIG. 2.
Figure 9:
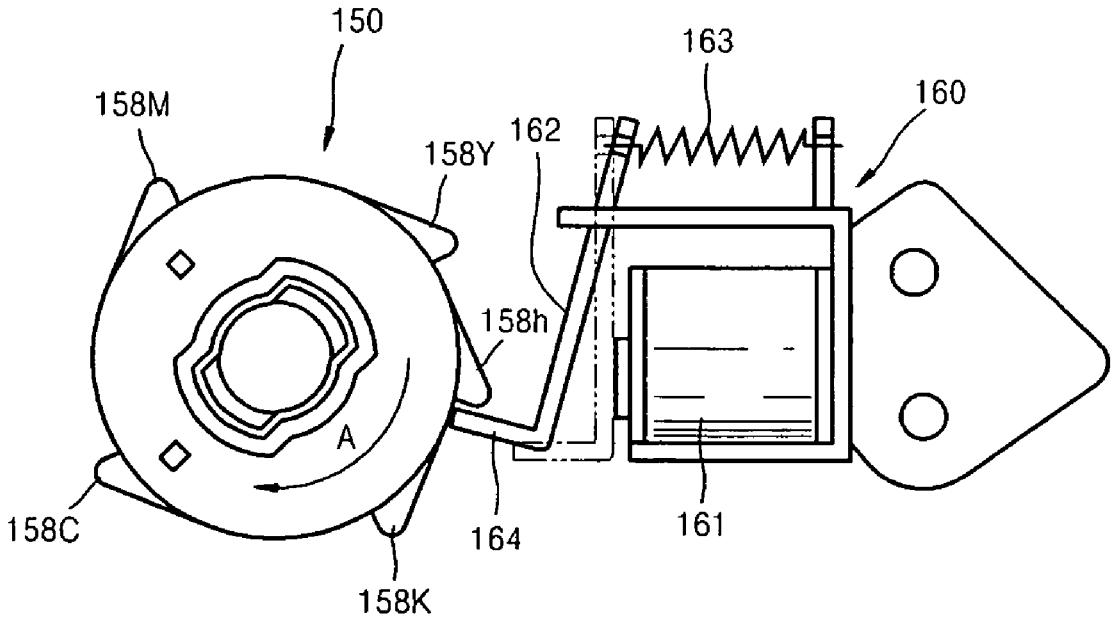
FIG. 9 is an elevational view illustrating operation of the spring clutch and the actuator of FIG. 2.

FIG. 8 is an exploded perspective view of the spring clutch 150. FIG. 9 is an elevational view illustrating operation of the spring clutch 150 and the actuator 160.

Referring to FIGS. 8 and 9, the spring clutch 150 includes a clutch gear 151, a clutch spring 159, a clutch hub 157, and a bushing 152.

The bushing 152 is fixed to one end of the cam shaft 120, and the clutch gear 151 is rotatably coupled to the bushing 152. The clutch spring 159 is inserted into both the clutch gear 151 and cylindrical portions 153 and 154 of the bushing 152.

The clutch hub 157 encompasses the clutch spring 159. On the clutch hub 157, four coupling portions 158Y, 158M, 158C, and 158K corresponding to the respective four cams 131 and a home position coupling portion 158*h* are formed. A first end 159*a* and a second end 159*b* of the clutch spring 159 are respectively inserted into inserting holes 155 and 156 formed on the bushing 152 and the clutch hub 157. The clutch gear 151 is connected to a gear 15 rotated by the driving motor 10. The driving motor 10 rotates the clutch gear 151 in the rotational direction indicated by an arrow A.

The clutch spring 159 is strongly tightened around the clutch gear 151 and cylindrical portions 153 and 154 of the bushing 152 as the clutch spring 159 is twisted in a direction in which the inner diameter of the clutch spring 159 decreases. Therefore, when the clutch gear 151 rotates in the direction indicated by arrow A, the clutch spring 159 and the bushing 152 rotate, and the cam shaft 120 also rotates. Because the second end 159*b* of the clutch spring 159 is inserted in the inserting hole 156 of the clutch hub 157, the clutch hub 157 rotates.

When current is not supplied to a coil unit 161 of the actuator 160, a stopper 164 of a moving side 162 moves forward and hooks one of coupling portions 158M, 158C, 158K 158Y, and 158*h*, as illustrated by solid lines in FIG. 9, thereby preventing rotation of the clutch hub 157.

When the clutch hub 157 does not rotate, the clutch spring 159 is twisted in a direction in which the inner diameter thereof increases because the second end 159*b* of the clutch spring 159 is inserted in the inserting hole 156 of the clutch hub 157. Then, the force of the clutch spring 159 tightening the cylindrical portion 153 of the clutch gear 151 decreases, and an inner diameter portion of the clutch spring 159 and the cylindrical portion 153 of the clutch gear 151 slip, and thus the clutch spring 159 and the bushing do not rotate. Therefore, the rotation of the cam shaft 120 stops. When current is supplied to the coil unit 161 of the actuator 160, the moving side 162 is adhered to the coil unit 161 as illustrated by dotted lines in FIG. 9 and the stopper 164 is separated from the coupling portions 158. Then, as described above, as the clutch gear 151 rotates, the cam shaft 120 also rotates.

Referring to FIGS. 2, 3 and 5, a position indicating element 132 is installed on the cam shaft 120 to check an initial location of the cam shaft 120.

The position indicating element 132 includes a plurality of indicating units 133 formed on its circumference. The indicating units 133 are disposed a predetermined distance from each other on the circumference of the position indicating element 132.

A sensor 140 is connected to the bracket 100 to sense the plurality of indicating units 133. The sensor 140 may be an optical sensor.

The sensor 140 measures the time taken by each of the plurality of indicating units 133 to pass through the sensor 140. Because the plurality of indicating units 133 have different circumferential lengths, the times taken by the indicating units 133 to pass through the sensor 140 are different from each other. Thus, the time taken by each of the plurality of indicating units 133 to pass through the sensor 140 is previously measured and stored, and then the sensor 140 may determine which indicating unit passes through the sensor 140 by comparing the predetermined time and the measured time for each of the indicating units 133 that passed through the sensor 140. This process will be described in detail later.

The plurality of coupling portions 158 are formed on the clutch hub 157 to correspond to the plurality of indicating units 133.

When the stopper 164 of the actuator 160 hooks one of the coupling portions 158, the cam shaft 120 stops rotating at a home position or a developing position.

The home position denotes a state in which neither of the four developing units 4 operate, that is, all of the four sliding hubs 104 and a fixed hub 104 are separated from each other. Therefore, the phase of the home position coupling portion 158*h* does not overlap with the phases of the four coupling portions 158Y, 158M, 158C, and 158K. Phases of the indicating units 133Y, 133M, 133C and 133K precedes the phases of the coupling portions 158Y, 158M, 158C and 158K, respectively.

When current supplied to the actuator 160 is cut off after the indicating units 133 are detected by the sensor 140, the moving side 162 is located at a position illustrated by solid lines in FIG. 9. When the cam shaft 120 rotates so that the stopper 164 hooks one of the coupling portions 158, the driving motor 10 is stopped and the cam shaft 120 stops at the home position or a developing position. FIG. 9 illustrates a state in which the stopper 164 hooks the home position coupling portion 158*h* so that the cam shaft 120 stops at the home position.

A method of controlling a home position or a developing position of each of developing units will be described below.

Figure 10:
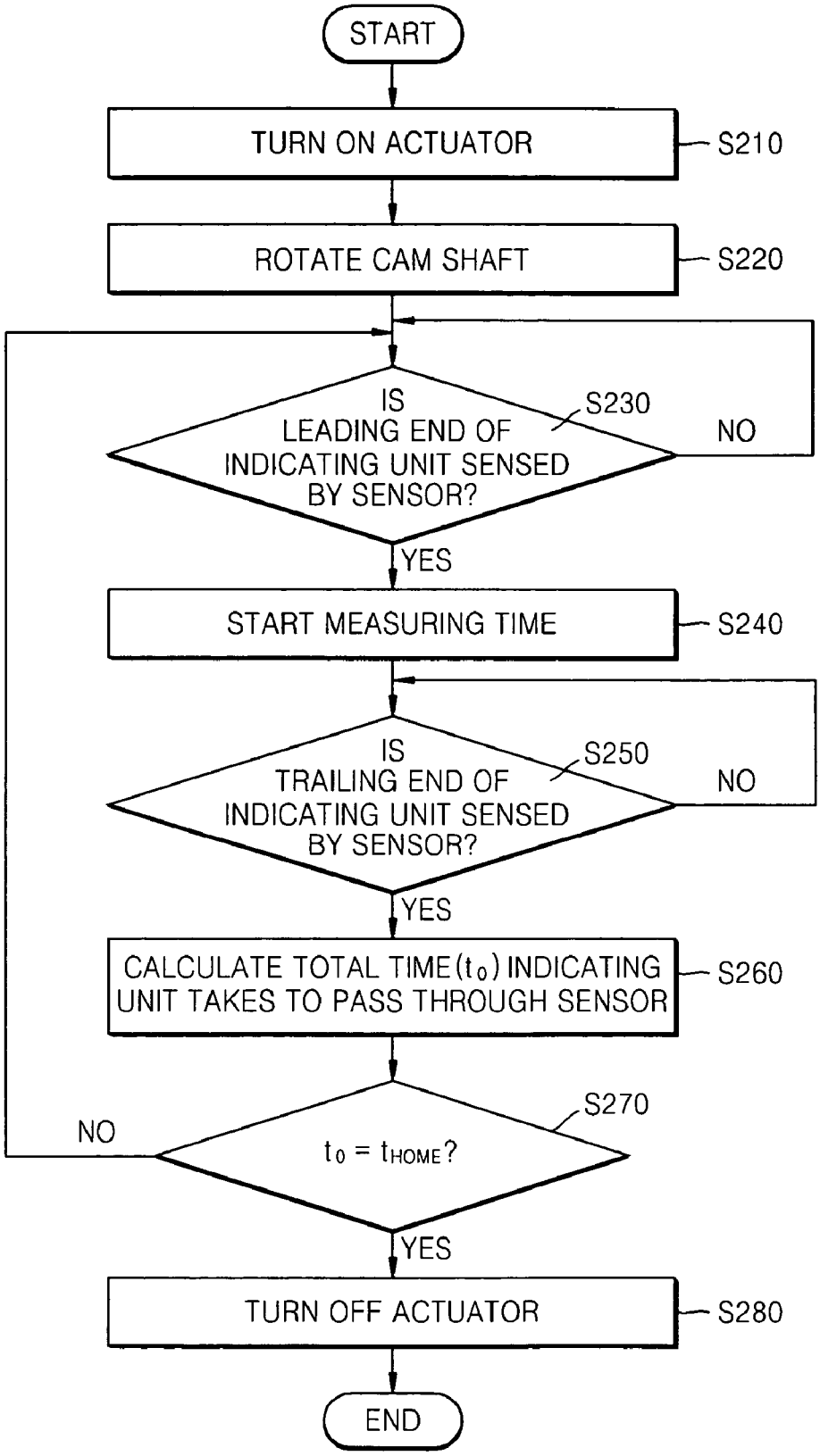
FIG. 10 is a flowchart of a method of controlling a home position of a cam shaft according to an exemplary embodiment of the present invention.

FIG. 10 is a flowchart of a method of controlling a home position of a cam shaft according to an exemplary embodiment of the present invention.

Referring to FIGS. 9 and 10, when current is supplied to the actuator 160, the moving side 162 is adhered to the coil unit 161 to be placed at a position illustrated by dotted lines and the plurality of coupling portions 158 are free (operation S210).

The cam shaft 120 rotates due to a driving force transmitted from the driving motor 10 (operation S220).

The sensor 140 senses a leading end of the indicating unit 133 (operation S230). When the leading end of the indicating unit 133 is sensed, the time begins to be measured (operation S240). When the leading end of the indicating unit 133 is not sensed, the process returns to the operation S230.

The sensor 140 senses a trailing end of the indicating unit 133, that is, whether the trailing end of the indicating unit 133 passes through the sensor 140 (operation S250). When the trailing end of the indicating unit 133 passes through the sensor 140, the measuring of time which has been performed since the operation S240 is finished and a total time $t_0$ taken by the indicating unit 133 to pass through the sensor 140 is calculated (operation S260). When the trailing end of the indicating unit 133 does not pass through the sensor 140, the process returns to the operation S250, and the time taken by the indicating unit 133 to pass through the sensor 140 is continuously measured.

The total time $t_0$ taken by the indicating unit 133 to pass through the sensor 140 is compared to the time $t_{home}$ taken by the home position indicating unit 133*h* to pass through the sensor 140 (operation S270). The time $t_{home}$ taken by the home position indicating unit 133*h* to pass through the sensor 140 is previously measured and stored.

When the total time $t_0$ taken by the indicating unit 133 to pass through the sensor 140 is substantially identical to the time $t_{home}$ taken by the home position indicating unit 133*h* to pass through the sensor 140, the actuator 160 is turned off, that is, the power transmitted to the actuator 160 is blocked (operation S280). When the actuator 160 is turned off, the moving side 162 returns to a location illustrated by a solid line in FIG. 9 due to an elastic force of a spring 163 and the stopper 164 is coupled to the home position coupling portion 158*h*. Therefore, the cam shaft 120 is placed at the home position.

Alternatively, when the total time $t_0$ taken by the indicating unit 133 to pass through the sensor 140 is not substantially identical to the time $t_{home}$ taken by the home position indicating unit 133*h* to pass through the sensor 140, the process returns to the operation S230 so that the time $t_0$ taken by the indicating unit 133 to pass through the sensor 140 and the above processes are repeated.

When the cam shaft 120 is placed at the home position, an electrostatic latent image corresponding to a yellow color image is formed on the photosensitive drum 1 according to an image forming process.

Figure 11:
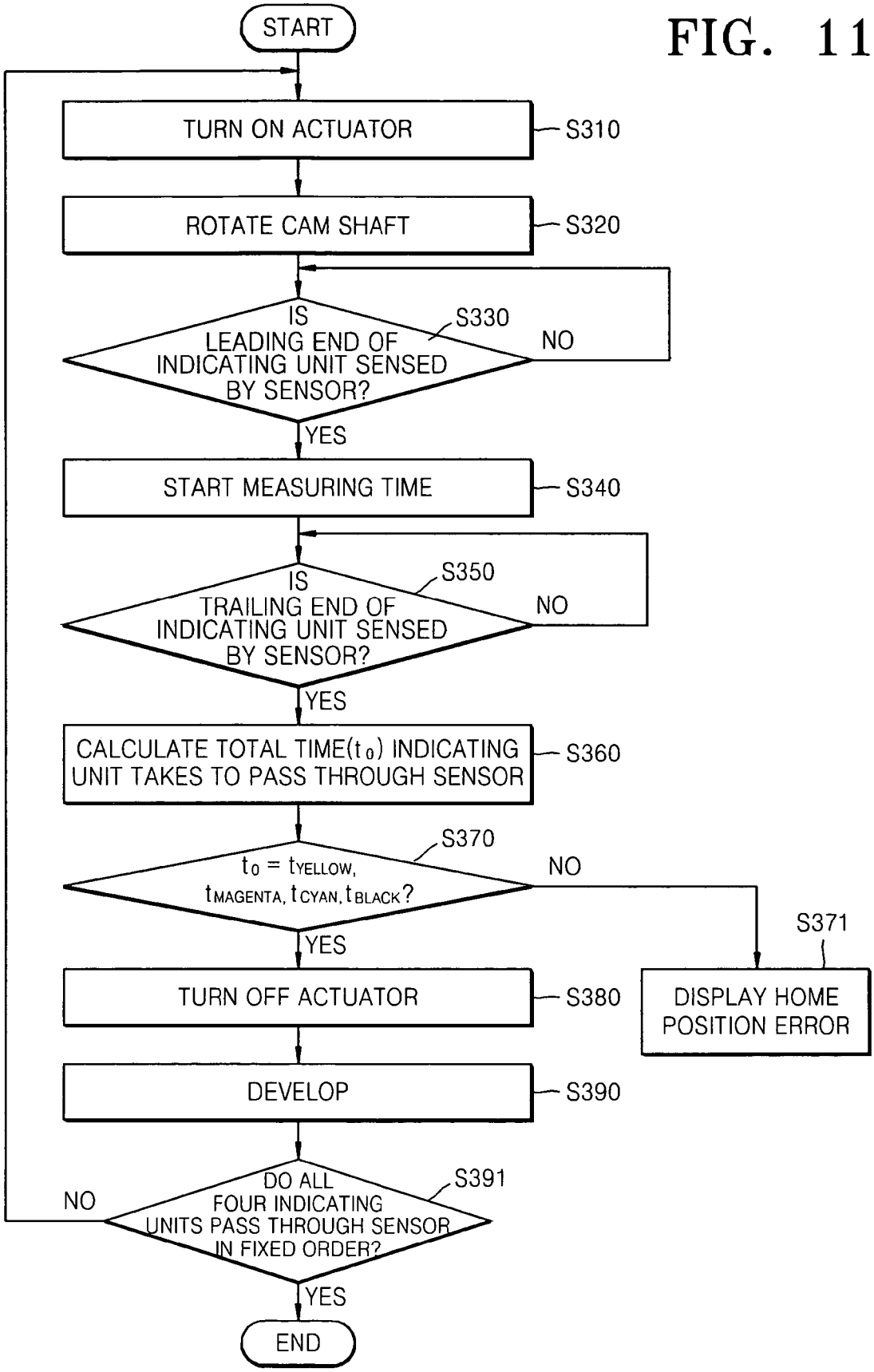
FIG. 11 is a flowchart of a method of controlling a developing position of each color of a cam shaft according to an exemplary embodiment of the present invention.

FIG. 11 is a flowchart of a method of controlling a developing position of each color of a cam shaft according to an exemplary embodiment of the present invention.

When current is supplied to the actuator 160, the moving side 162 is adhered to the coil unit 161 and placed at a position illustrated by dotted lines, and the plurality of coupling portions 158 are in a free state, as shown in FIG. 9 (operation S310). Particularly, the home position coupling portion 158*h* is released from the stopper 164.

The cam shaft 120 rotates due to the driving force transmitted from the driving motor 10 (operation S320). As the cam shaft 120 rotates, the cam 131Y pushes the push cap 110Y, thereby coupling the sliding hub 104Y with the fixed hub 106Y.

The sensor 140 senses the leading end of the indicating unit 133 (operation S330). When the leading end of the indicating unit 133 is sensed by the sensor 140, the time begins to be measured (operation S340). When the leading end of the indicating unit 133 is not sensed, the process returns to the operation S330.

The sensor 140 senses the trailing end of the indicating unit 133, that is, whether the trailing end of the indicating unit 133 passes through the sensor 140 (operation S350). When the trailing end of the indicating unit 133 passes through the sensor 140, the measuring of time that started after the operation S340 is finished and the total time $t_0$ taken by the indicating unit 133 to pass through the sensor 140 is calculated (operation S360). When the trailing end of the indicating unit 133 has not passed through the sensor 140, the process returns to the operation S350, and the time taken by the indicating unit 133 to pass through the sensor 140 is continuously measured.

The total time $t_0$ taken by the indicating unit 133 to pass through the sensor 140 is compared with the time $t_{yellow}$ taken by the yellow indicating unit 133Y to pass through the sensor 140 (operation S370). At this time, the time $t_{yellow}$ taken by the yellow indicating unit 133Y to pass through the sensor 140 is measured and stored.

When the total time $t_0$ taken by the indicating unit 133 to pass through the sensor 140 is substantially identical to the time $t_{yellow}$ taken by the yellow indicating unit 133Yto pass through the sensor 140, the actuator 160 is turned off, that is, the power transmitted to the actuator 160 is blocked (operation S30). When the actuator 160 is turned off, the moving side returns to the location indicated by the solid line in FIG. 9 due to the elastic force of the spring 163, and the stopper 164 is coupled with the yellow coupling portion 158Y. When the yellow coupling portion 158Y is coupled with the stopper 164, the rotational force transmitted from the driving motor 10 to the cam shaft 120 is blocked by the spring clutch 150, and the cam shaft 120 stops rotating.

The sliding hub 104Y and the fixed hub 106Y mesh to drive the developing unit 4Y, and the developing roller 5Y develops an electrostatic latent image formed on the photosensitive drum 1 to a yellow color image (operation S390).

Meanwhile, when the total time $t_0$ taken by the indicating unit 133 to pass through the sensor 140 is not substantially identical to the time $t_{yellow}$ taken by the yellow indicating unit 133Y to pass through the sensor 140 in the operation S370, it is determined that the home position indicating unit 133*h* is placed at an improper position and the occurrence of a home position error is displayed (operation S371).

To develop an image, developing is sequentially performed, starting from the home position, in the order of, for example, yellow, magenta, cyan, and black colors. Hence, from the home position, the first developed color should be a yellow color, but if it is determined that the indicating unit 133 passing through the sensor 140 is not the yellow indicating unit 133Y, the home position indicating unit 133*h* is not placed at a proper position. Therefore, the occurrence of the home position error is displayed, thereby enabling a user to correct the home position error. Furthermore, a recovery function for a detective image due to the home position error may be performed by re-outputting the defective image.

After the operation S390, it is determined whether all of the four indicating units 133Y, 133M, 133C, and 133K sequentially pass through the sensor 140 (operation S391). When it is determined that all of the four indicating units 133Y, 133M, 133C, and 133K sequentially passed through the sensor 140, a color developing is completed. The order of the indicating units 133Y, 133M, 133C, and 133K is arbitrary and may be changed.

When it is determined that not all of the indicating units 133Y, 133M, 133C, and 133K sequentially pass through the sensor 140, the process returns to the operation S310 and the above operations are repeated to sequentially develop colors that are not yet developed.

In particular, in the operation 370, it is determined that the indicating units 133M, 133C, and 133K sequentially passed through the sensor 140, and the four colors are consecutively dropped. Alternatively, if the four indicating units 133Y, 133M, 133C, and 133K do not sequentially pass through the sensor 140, a home position error occurs (operation 391), and thus the occurrence of home position error may be detected in each color developing operation.

As described above, an image forming apparatus according to an exemplary embodiment of the present invention includes an indicating element having indicating units of different sizes and detects a home position error occurrence, thereby improving image quality.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of detecting a home position error for an image forming apparatus, comprising the steps of turning on an actuator;

determining whether a leading end of an indicating unit is sensed by a sensor;

determining whether a trailing end of the indicating unit is sensed by the sensor;

determining whether a total time taken by the indicating unit to pass through the sensor is substantially identical to a predetermined time taken by at least one of yellow, magenta, cyan and black indicating units to pass through the sensor, each of the yellow, magenta, cyan and black indicating units having a different circumferential length; and displaying a home position error message when the total time taken by the indicating unit to pass through the sensor is not substantially identical to the predetermined time taken by one of the yellow, magenta, cyan and black indicating units to pass through the sensor when determining whether the total time taken by the indicating unit to pass through the sensor is substantially identical to the predetermined time.

2. The method of claim 1, further comprising the step of turning off the actuator when the total time taken by the indicating unit to pass through the sensor is substantially identical to the predetermined time taken by one of the yellow, magenta, cyan and black indicating units to pass through the sensor when determining whether the total time taken by the indicating unit to pass through the sensor is substantially identical to the predetermined time.

3. The method of claim 2, further comprising after turning off the actuator the steps of developing each color; and determining whether all of the four indicating units sequentially pass through the sensor.

4. The method of claim 3, further comprising the step of returning to the turning on of the actuator step and repeating the following operations when not all of the four indicating units sequentially pass through the sensor.

5. The method of claim 1, wherein the indicating units are disposed a predetermined distance from each other.

* * * * *